US005383480A

United States Patent [19]

Clyburn

[11] Patent Number: 5,383,480

[45] Date of Patent: Jan. 24, 1995

[54] HAIR WAVING DEVICE AND METHOD

[76] Inventor: Belinda Clyburn, 13 Hewitt La., Sicklerville, N.J. 08081

[21] Appl. No.: 228,746

[22] Filed: Apr. 19, 1994

[51] Int. Cl.[6] ..... A45D 7/04; A45D 2/00

[52] U.S. Cl. ..... 132/207; 132/203; 132/223; 132/210

[58] Field of Search ..... 132/223, 226, 53, 54, 132/200, 203, 207, 210, 211

[56] References Cited

U.S. PATENT DOCUMENTS

| | | | |
|---|---|---|---|
| 1,452,577 | 4/1923 | Turpin | 132/223 |
| 1,558,106 | 10/1925 | McGowan | 132/223 |
| 1,662,319 | 3/1928 | McGowan . | |
| 1,709,434 | 4/1929 | Hollier | 132/223 |
| 1,845,606 | 2/1932 | Kaplan et al. | 132/223 |
| 1,904,150 | 4/1933 | Lewis | 132/223 |
| 1,925,009 | 1/1933 | Siegel | 132/223 |
| 3,109,438 | 11/1963 | Work | 132/31 |
| 3,812,867 | 5/1974 | Wanderman et al. | 132/53 |
| 4,215,709 | 8/1980 | Carr | 132/9 |
| 5,042,511 | 8/1991 | Haddad | 132/208 |

FOREIGN PATENT DOCUMENTS

| | | | |
|---|---|---|---|
| 247874 | 1/1948 | Austria | 132/55 |
| 8307402 | 11/1983 | France . | |

*Primary Examiner*—John G. Weiss

*Attorney, Agent, or Firm*—Thomas A. Lennox

[57] ABSTRACT

A device and method is provided for molding parallel waves extending outwardly from the person's scalp. The device includes a band attached tightly around the person's head with a plurality of flexible members attached and extending from one side of the person's head over the hair to the other side of the head and attached to the band wherein the flexible members are held tightly against the person's hair that is combed rearwardly from the forehead hair line. The flexible members are pushed downwardly against the hair and forwardly back toward the hair line forming a wave in front of each member.

16 Claims, 3 Drawing Sheets

HAIR WAVING DEVICE AND METHOD

BACKGROUND OF THE INVENTION

This invention involves a device for molding and pushing hair waves on a person's head and a method for molding the waves and setting same.

It is long been popular to mold and set waves in person's hair. Even if the person has natural curly hair it has still be fashionable to impart patterns and in particular waves to the hair. An example of such a hair treatment is described and illustrated in Swiss Patent No. 247,874 issued Jan. 3, 1948 incorporated herein by reference thereto. As shown in those diagrams, the style if formed by pulling the hair in a certain direction, generally from the forehead to the rear. Using combs, brushes or picks as well as the hair dresser's hands the waves are pushed back toward the roots of the hair. A large quantity of styling gel is applied to the hair that is generally moistened. A technique is to pull the hair rearwardly with a comb and then hold the hair in place with a rat tail comb. The next step is to push the wave back with the rear comb toward the rat tail comb. After the waves have been formed, the hair is heated and dried under a commercial dryer. After the waves have dried, the waves are lifted slightly with a comb or picked to obtain some body, after which the hair is dried again. The time to accomplish this dressing is at least one hour and can only be accomplished by the most skilled beauticians. It is virtually impossible for a person to accomplish such styling on the person's own head.

A number of devices have been provided to aid in the styling of hair. The device described in the U.S. Pat. No. 1,662,319 has elastic cords connecting curved comb members which extend between opposite sides of a horizontal head strap around the head. The elastic cord connection allows the comb members to be moved longitudinally to create a swirl pattern by pushing one comb one way, the next comb is moved longitudinally in the opposite direction to form a wave pattern of the hair that is essentially plastered to the head.

Other hair shaping devices include a hair shaping and lifting system in U.S. Pat. No. 4,215,709, an apparatus and method for selective coloring of hair in the U.S. Pat. No. 5,042,511, a hair waving appliance in the U.S. Pat. No. 4,109,438 and a method for permanent waving hair without curlers in French Patent No. 2,545,337.

None of these devices can be effectively used to attain the molding of the hair waves described above and they further can not attain the objects described herein below.

SUMMARY OF INVENTION

It is an object of the present invention to provide a device and method by which a beautician or a person working on their own hair may form waves extending across the person's hair in parallel rows, much in the form of enlarged ripples in a pond.

It is a further object of the present invention to provide a device and method of forming said waves with a greatly shortened time and reduced skill on the part of the operator.

It is an additional object of the present invention to form said waves using setting lotion to attain relatively soft waves rather than the styling gel required with the old method. It is also possible with the present invention to utilize the cold wave perm system to attain body, which is again not possible with the old method.

An aspect of the invention is a device to aid in forming parallel waves of hair molded outwardly from a person's scalp and extending across the person's head. The device includes a band that includes a length sufficient to extend in a ring around the person's head and means to lengthwise adjustably hold the band around the person's head. The device further includes a plurality of flexible members, each member including first and second ends, a length and a continuous lengthwise surface. The device also includes attachment means to attach the first ends of the members juxtaposed along a first section of the band and attach the second ends of the members juxtaposed along a second section of the band. The positions of the first and second sections along the length of the band, the attachment means and the length of each member place each of the members in an arcuate shape and the members in a parallel relationship with each other to fit the continuous lengthwise surface of each member snugly against the person's head when the band is attached on the person's head.

It is preferred that the means to hold the band around the person's head be a combination of a size and shape of the band, and an elastomeric composition of the band sufficient to allow the band to be stretched to size to fit over the person's head and recover to hold the band tight against the person's head. It is further preferred that the means to hold the band on the person's head includes two free ends of the band and means to detachably attach the ends of the band together. It is also preferred that the band fit tightly horizontally across the person's forehead and around a back of the person's head. It is further preferred that the members include an outer cylindrical surface. It is also preferred that the arcuate shape of the members and length of the members allow the parallel rows of the members to be aligned lengthwise across the person's head from side to side. It is further preferred that the attachment means includes a plurality of tubular covers into which each of the members interfits, wherein each tubular cover includes ends attached to the band. It is further preferred that the tubular covers include nylon woven fabric. It is also preferred that there be three to ten members, and more preferred that there be four to eight members. It is further preferred that the means to detachably attach includes complimentary strips of a hook attachment fabric and a loop attachment fabric attached on opposite sides proximate opposite ends of the band. It is also preferred that the members include flexible polymeric plastic tubing. It is further preferred that the device be an integral molding of an elastomeric polymer.

Another aspect of the invention is a method to form parallel waves of hair molded outwardly from a person's scalp and extending across the person's head. The method includes providing a device as described immediately hereinabove. The method further includes applying setting means to the person's hair and combing the person's hair in a chosen direction exposing a line of roots of the hair. The method then includes placing the device on the person's head by extending the band in a ring around the person's head, while aligning the lengths of the members snugly against the hair and across the top of the head parallel with the line of roots. The method further includes that with said means holding the band to the head. The method also includes applying pressure and pushing a flexible member downwardly and toward the line of roots forming a wave of hair in front of the moving flexible member. The method further includes forming a wave of hair in front of each flexible member. The method then includes drying the hair to cause the setting means to set the waves in the molded wave shape.

It is preferred that the flexible member chosen for applying pressure and pushing downwardly and toward the line of roots be a flexible member furthest from the line of roots. It is further preferred that the flexible member chosen for applying pressure and pushing downwardly and toward the line of roots be a first flexible member closest to the line of roots forming a wave of hair between the line of roots and the first flexible member, and the method further includes applying pressure and pushing on a second flexible member next further away from the line of roots downwardly and toward the line of roots forming a wave of hair between the first flexible member and the second flexible member, and continuing likewise with each of the remaining flexible members working away from the line of roots forming a wave of hair between each adjacent pair of flexible members. It is preferred that the line of roots be across person's forehead.

DESCRIPTION OF PREFERRED EMBODIMENTS

With the present invention, a person can form the waves and set one's owns hair without the need of a skilled beautician. With the device on the person's head, it is effective to push on each band one at a time going from front to back. This pushing forwardly forms a wave in the front of the member as it is moved. A second, quite effective and even easier method is to merely push forwardly on the rear member and all of the members in front will follow each pushing a wave of hair in front of them toward the front of the head. Because of the device, it is possible to achieve excellent results with a minimum of water on the hair. Further, setting lotions may be used with the device and method so that the drying time necessary in the old method to remove the water and to set the styling gel is avoided. With the present invention, a short drying time is necessary followed by removal of the device. An additional ten minutes of drying removes the dampness and sets the hair that was in the area under the bands of the device.

With the present invention, since setting lotion may be used in place of the styling gel, it is possible to pluck and comb the waves immediately. The waves will remain in an extremely pleasing appearance. On the other hand, since hard styling gel was necessary with the old method, it was necessary to use an oil before attempting to comb the hair. This old combination, of oil and styling gel immediately loads the hair with a large quantity of unwanted material.

Figure 1:
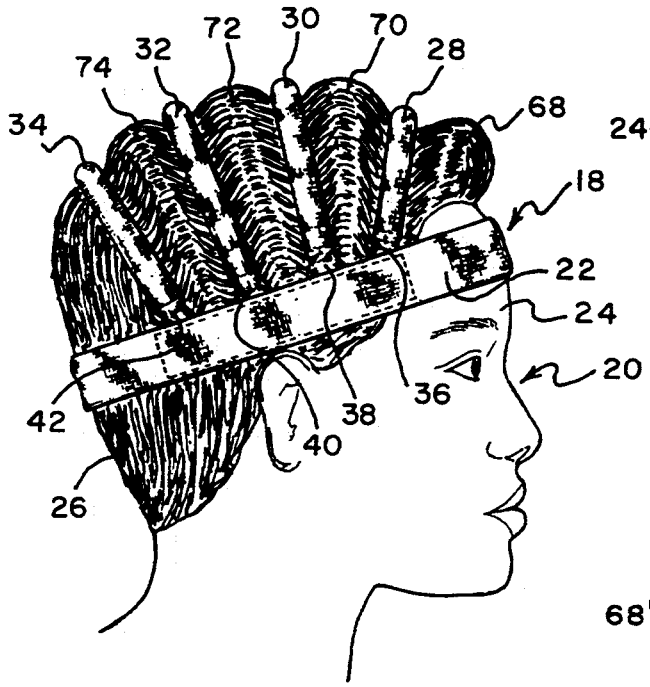
FIG. 1 is a left side elevational view of a device from this invention on a person's head after the waves have been formed.
Figure 3:
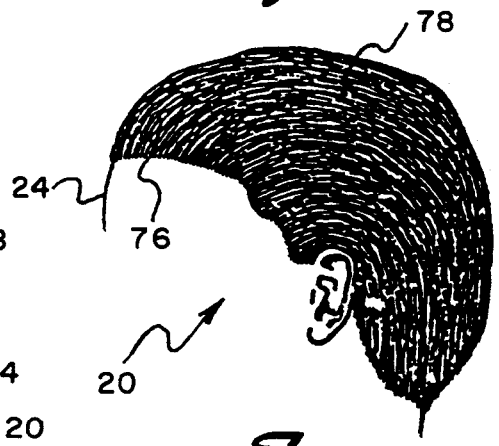
FIG. 3 is a right side view of a person's head with the hair combed back from the forehead ready for placement of said device.
Figure 4:
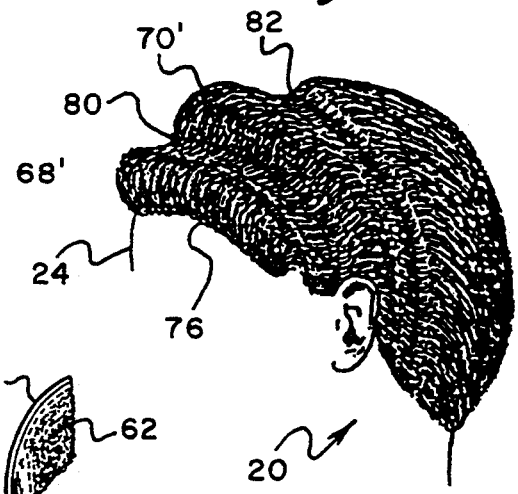
FIG. 4 is a right side view of the person's head shown in FIG. 3 after the first two waves have been formed with said device.
Figure 2:
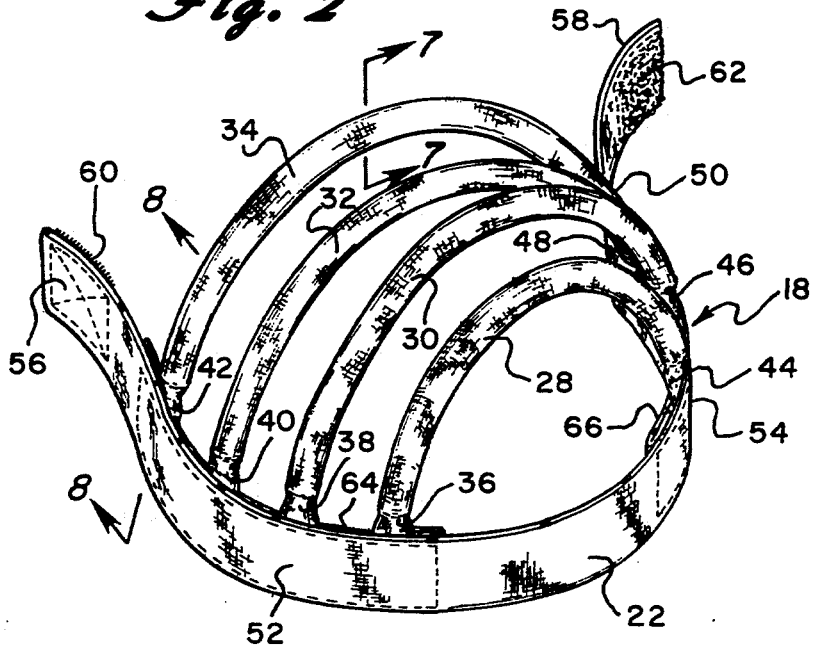
FIG. 2 is top, front, left side perspective view of the device illustrated in FIG. 1.

As illustrated in FIGS. 1 and 2, device 18 is fitted on person's head 20 with strap 22 encircling the head over forehead 24 and around back of head 26. Flexible members 28, 30, 32 and 34 are tight against the head of person 20 having formed front wave 68, wave 70, wave 72, and rear wave 74 using a method of this invention. As seen in FIG. 2, ends 36, 38, 40 and 42 of flexible members 28, 30, 32, and 34 respectively are connected to section 52 of strap 22 each end being juxtaposed along the length of section 52. On the opposite side of strap 22 is section 54 with ends 44, 46, 48 and 50 of members 28, 30, 32 and 34 respectively connected juxtaposed and spaced apart along the length of section 54. Reinforcing fabric swatch 64 extends over the ends to aid in the connection by stitches to section 52 of strap 22. Likewise, reinforcing fabric swatch 66 extends over the opposite ends of the members to connect them to section 54. The members are of differing lengths with member 28 being the shortest arcuate length and member 34 being the longest. The length as well as the positioning of the connection of the ends of the members provide that they fit closely against the head when strap 22 is connected as shown in FIG. 1. The connection of strap 22 is accomplished by attachment hook VELCRO® fabric patch 60 on one side of strap 22 at end 56 with loop VELCRO® fabric patch 62 stitchably attached on the opposite side of strap 22 at end 58. The length of the VELCRO® fabric patches allow length adjustment for a tight fit to the person's head. It should be noted that strap 22 can be attached on the head in a number of different configurations. For example, the strap can be tilted rearwardly so that the front end of the strap is over the hair and the rear end of the strap is down close to the neck. This allows waves to be formed on the rear of the head leaving the front of the hair to be dressed in a different fashion. It is also effective to horizontally twist strap 90° so that the members extend from the forehead rearwardly to allow waves to be formed with the crests of the waves extending from the forehead rearwardly. In this instance, the hair would be combed from one side of the head over the top toward the other side and the waves would be formed by pushing the hair back toward the exposed hair line in a method of using the invention. It is, of course, satisfactory to move each flexible member individually to form the wave. For example, wave 68 can be formed by pushing member 28 against the scalp and frontwardly toward the forehead. Then, wave 70 can be likewise formed by pushing member 30 downwardly and toward the forehead. Each wave in turn to the rear may be formed in the same fashion. However, a quicker and an effective method is to form all of the waves at the same time by pushing downwardly on member 34 and pushing it forwardly toward the forehead of the person. Wave 74 rides upwardly and pushes member 32 forwardly to form wave 72 which in turn pushes member 30 forwardly to form wave 70 and, which in turn pushes member 28 forwardly to form first wave 68. Treatment of the hair may be accomplished with just water but a setting lotion is preferred. Styling gel should be avoided as it provides little advantages and does not perform as well in forming the waves. As shown in FIG. 3, the first step of the method is to comb hair 78 rearwardly away from forehead 22 exposing hairline 76. After device 18 is attached, the members are pushed forwardly to form the waves and the hair dried. The device is removed leaving the waves as shown in FIG. 4. In this embodiment, only two members were used forming front wave 68' in front of trough 80 and wave 70' in front of trough 82. The troughs are formed by the members pressing downwardly against the scalp After drying the waves may be immediately slightly lifted and picked to attain additional body.

Figure 5:
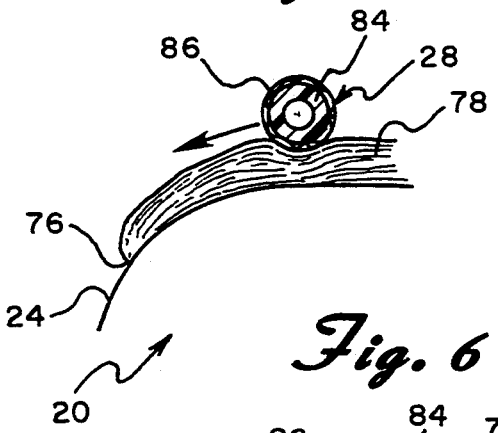
FIG. 5 is an expanded view of a section of the head shown in FIG. 3 before the method is used.
Figure 7:
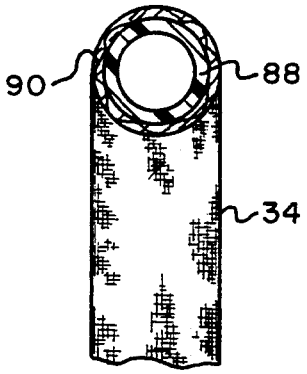
FIG. 7 is a cutaway cross-sectional view taken along lines 7—7 of FIG. 2.
Figure 6:
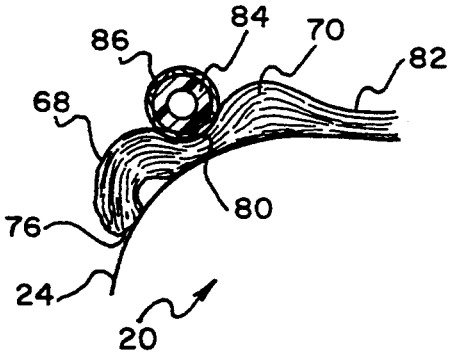
FIG. 6 is a view of the head shown in FIG. 5 with a vertical cross-section of a member of the device being moved forwardly to form a wave.
Figure 8:
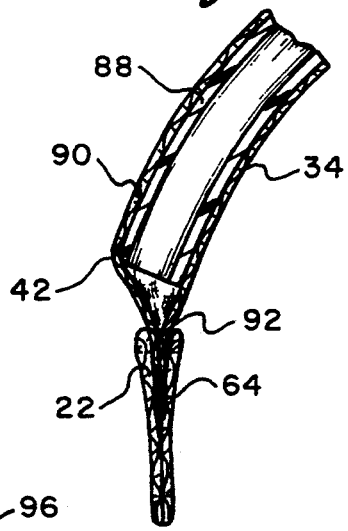
FIG. 8 is a cutaway cross-sectional view taken along lines 8—8 of FIG. 2.

As shown in FIG. 5, hair 78 has been combed rearwardly exposing hairline 76. Member 28 is pressed against the hair and the scalp. Each member is constructed of flexible plastic tubing 84, such as TYGON® tubing or standard rubber tubing encased in nylon cloth sleeve 86. Member 28 is pressed downwardly and frontwardly to form wave 68 as shown in FIG. 6. Likewise, wave 70 has been formed in front of trough 82 by a member not illustrated. In FIG. 7, member 34 is shown constructed of hollow tubing 88 encased in cloth sleeve 90. End 42 of member 34 is connected to strap 22 as shown in FIG. 8. End 92 of sleeve 90 is stitchably attached between cloth panel 64 and strap 22 providing for a flexible attachment between the member and the strap.

Figure 9:
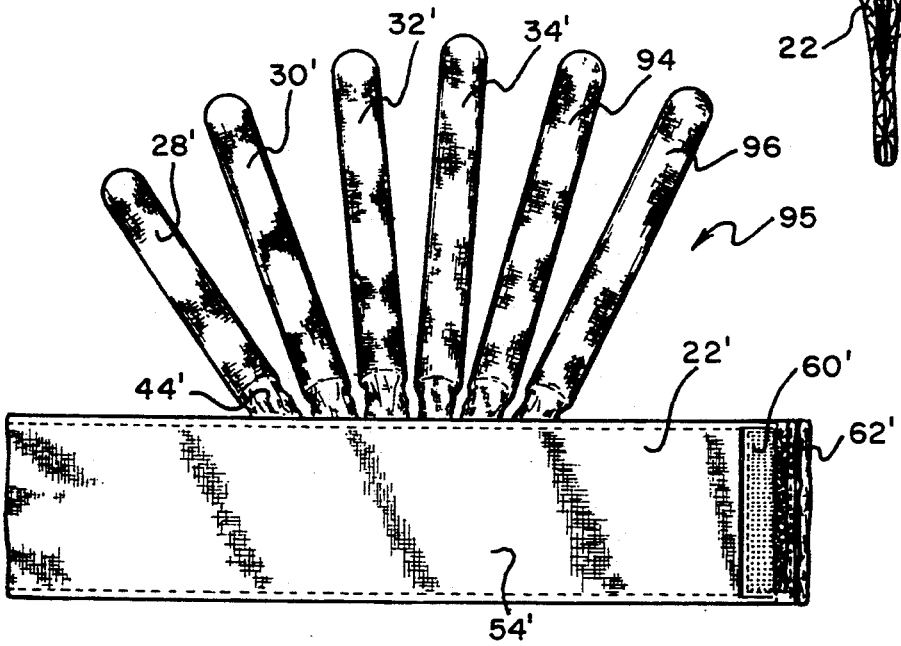
FIG. 9 is a right side elevational view of a second embodiment of a device of this invention.
Figure 10:
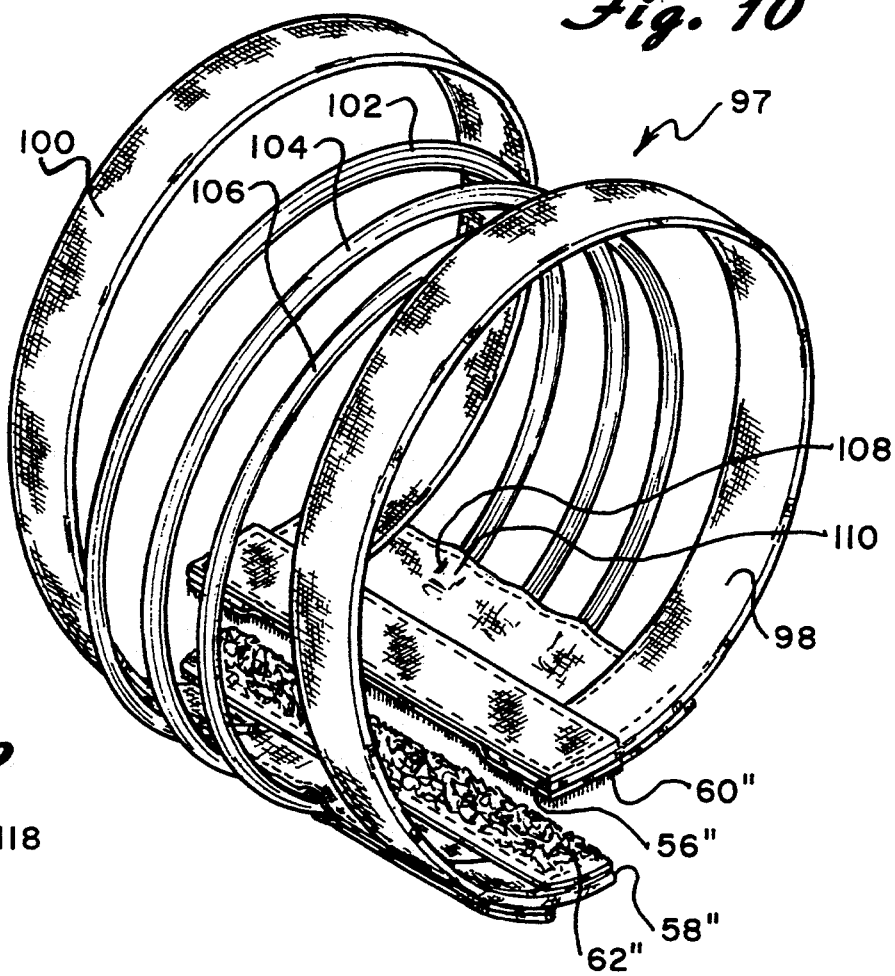
FIG. 10 is perspective view of a third embodiment of this invention.

Device 95 is illustrated in FIG. 9 with six members, 28' 30', 32', 34', 94 and 96 all connected at one end to section 54' and at the other end to section 52', hidden in this view. It is preferred that the number of members be in the range of two to ten, more preferably three to eight and most preferably four to six. Device 95 is constructed in the same fashion as device 18. Device 97 as illustrated in FIG. 8 includes first strap 98 and second strap 100 held in a parallel configuration by end sections 56" and 58". Velcro strips 60" and 62" are connected traverse to the length of straps 98 and 100 to allow tight connection to the head. Device 97 is particularily effective to attach to the head to form waves close to the back of a person's head at various angles from the horizontal. Tubes 102, 104 and 106 are connected at their ends to end section 56" and 58" in a parallel configuration. These tubes are not encased in fabric but are exposed hollow rubber flexible three eighths inch diameter tubes that perform very effectively. The ends of the tubes, such as end 108, are connected by stitching connection 110 directly to the strap end section.

Figure 12:
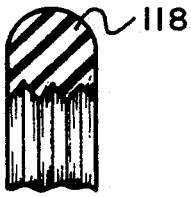
FIG. 12 is a cross-sectional view taken along line 12 of FIG. 11
Figure 11:
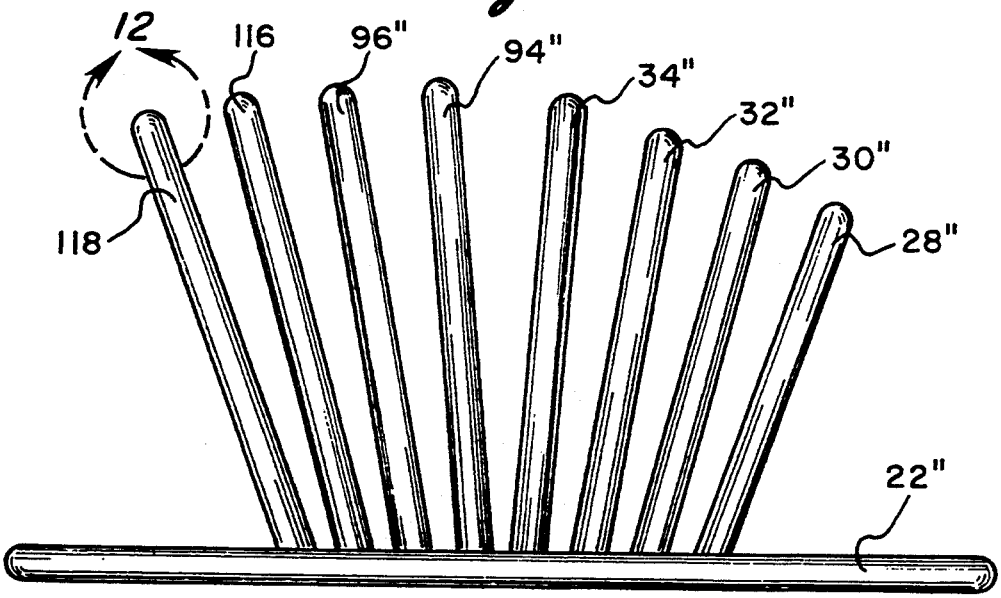
FIG. 11 is a side elevational view of a fourth embodiment of this invention.

The device illustrated in FIG. 11, is molded in one piece out of flexible rubber. Members 28", 30", 32", 34", 94', 96', 116 and 118 are all solid rubber sections of the molding. The lengthwise continuous surface of these members includes an anti-slip surface, that being ridge's as shown in FIG. 12, running the length of each member positioned to contact the hair of the person running the length of each member with the lengthwise surface positioned to contact the hair of the person to resist sliding during the forming of the waves. Strap 22' is one continuous ring which stretched to fit over the head and hold tightly around it.

The shape of the flexible members may vary widely. The shape of the flexible members may be square or rectangular in shape and may even be flat ribbon like members of either flexible plastic, such as plasticized polyvinyl chloride or elastomeric such as rubber. The flexible members may be hollow tubes or solid. In addition to the ridges formed longitudinally along the members such as in the device illustrated in FIG. 11, formed undulations including little flexible fingers can be formed laterally across the members, again to increase the friction between the flexible members and the hair. As illustrated in the devices 97 and that of FIG. 11, it is not necessary to have a highly flexible connection between the flexible members and the strap. With the flexibility of the members, they will bend to allow movement across the scalp sufficient distance to form the waves. In practice, even the smooth rubber tubes without the fabric covering have sufficient grabbing affect such that there is little sliding across the surface of the hair. Thus, even a smooth surface has sufficient friction and is effective in the method of this invention. It is possible to connect any of the devices illustrated to larger devices that extend down the neck of the person and even to the back of the person to form waves in a similar fashion on hair that is quite long.

While this invention has been described with reference to specific embodiments disclosed herein, it is not confined to the details set forth and the patent is intended to include modifications and changes which may come within and extend from the following claims.

I claim:

1. A method to form parallel waves of hair molded outwardly from a person's scalp and extending across the person's head, the method comprising:

(A) providing a device comprising:

(i) a band comprising a length sufficient to extend in a ring around the person's head, (ii) means to lengthwise adjustably hold the band around the person's head, (iii) a plurality of flexible members, each member comprising first and second ends, a length and a continuous lengthwise surface, and (iv) attachment means to attach the first ends of the members juxtaposed along a first section of the band and attach the second ends of the members juxtaposed along a second section of the band, wherein positions of the first and second sections along the length of the band, the attachment means and the length of each member place each of the members in an arcuate shape and the members in a parallel relationship with each other to fit the continuous lengthwise surface of each member snugly against the person's head when the band is attached on the person's head, (B) applying setting means to the person's hair and combing the person's hair in a chosen direction exposing a line of roots of the hair, (C) placing the device on the person's head by extending the band in a ring around the person's head, while aligning the lengths of the members snugly against the hair and across the top of the head parallel with the line of roots, (D) with said means holding the band to the head, (E) applying pressure and pushing a flexible member downwardly and toward the line of roots forming a wave of hair in front of the moving flexible member, (F) forming a wave of hair in front of each flexible member, and (G) drying the hair to cause the setting means to set the waves in the molded wave shape.

2. The method of claim 1 wherein the flexible member chosen for applying pressure and pushing downwardly and toward the line of roots is a flexible member furthest from the line of roots.

3. The method of claim 1 wherein the flexible member chosen for applying pressure and pushing downwardly and toward the line of roots is a first flexible member closest to the line of roots forming a wave of hair between the line of roots and the first flexible member, and the method further comprises:

(A) applying pressure and pushing on a second flexible member next further away from the line of roots downwardly and toward the line of roots forming a wave of hair between the first flexible member and the second flexible member, and (B) continuing likewise with each of the remaining flexible members working away from the line of roots forming a wave of hair between each adjacent pair of flexible members.

4. The method of claim 1 wherein the line of roots is across person's forehead.

5. The method of claim 1 wherein providing the device further comprises providing that the means to hold the band around the person's head is a combination of a size and shape of the band, and an elastomeric composition of the band sufficient to allow the band to be stretched to size to fit over the person's head and recover to hold the band tight against the person's head.

6. The method of claim 1 wherein providing the device further comprises providing that the means to hold the band on the person's head comprises two free ends of the band and means to detachably attach the ends of the band together.

7. The method of claim 1 wherein providing the device further comprises providing that the band fits tightly horizontally across the person's forehead and around a back of the person's head.

8. The method of claim 1 wherein providing the device further comprises providing that the members comprise an outer cylindrical surface.

9. The method of claim 1 further comprises providing that the arcuate shape of the members and length of the members allow the parallel rows of the members to be aligned lengthwise across the person's head from side to side.

10. The method of claim 1 wherein providing the device further comprises providing that the attachment means comprises a plurality of tubular covers into which each of the members interfits, wherein each tubular cover comprises ends attached to the band.

11. The method of claim 10 wherein the tubular covers comprise nylon woven fabric.

12. The method of claim 1 wherein providing the device further comprises providing that there be three to ten members.

13. The method of claim 12 wherein there are four to eight members.

14. The method of claim 6 wherein providing the device further comprises providing that the means to detachably attach comprises complimentary strips of a hook attachment fabric and a loop attachment fabric attached on opposite sides proximate opposite ends of the band.

15. The method of claim 1 wherein providing the device further comprises providing that the members comprise flexible polymeric plastic tubing.

16. The method of claim 1 wherein providing the device further comprises providing that the device be an integral molding of an elastomeric polymer.

* * * * *